US006722700B1

(12) United States Patent
Christen

(10) Patent No.: US 6,722,700 B1
(45) Date of Patent: Apr. 20, 2004

(54) DATA CARRIER AND METHOD FOR PRODUCING SAME

(75) Inventor: Paul Christen, Aarau (CH)

(73) Assignee: TRUB AG (CH)

( * ) Notice: Subject to any disclaimer, the term of this patent is extended or adjusted under 35 U.S.C. 154(b) by 0 days.

(21) Appl. No.: 09/958,243

(22) PCT Filed: Sep. 3, 2000

(86) PCT No.: PCT/CH00/00137

§ 371 (c)(1),
(2), (4) Date: Oct. 5, 2001

(87) PCT Pub. No.: WO00/61379

PCT Pub. Date: Oct. 19, 2000

(30) Foreign Application Priority Data

Apr. 7, 1999 (CH) ..... 649/99
Oct. 6, 1999 (CH) ..... 1827/99

(51) Int. Cl.[7] ..... B42D 15/00

(52) U.S. Cl. ..... 283/107; 283/109; 283/67; 283/86; 283/91; 428/40.1

(58) Field of Search ..... 283/72, 74, 86, 283/91, 93, 94, 107, 108–111; 428/40.1; 427/258, 208

(56) References Cited

U.S. PATENT DOCUMENTS 6,113,149 A * 9/2000 Dukatz ..... 283/91

* cited by examiner

*Primary Examiner*—Willmon Fridie, Jr.
(74) *Attorney, Agent, or Firm*—Webb Ziesenheim Logsdon Orkin & Hanson, P.C.

(57) ABSTRACT

The data carrier is preferably an identity card or payment card and is provided with at least one layer forming a card body, a transparent outer layer laminated thereon and a planar security element that is arranged between two laminated layers and that is covered by a protective layer. At least one of the laminated layers is transparent. The security element laminated therein is provided with especially holographic or kinegraphic information and is particularly protected against damage.

19 Claims, 2 Drawing Sheets

Fig. 1
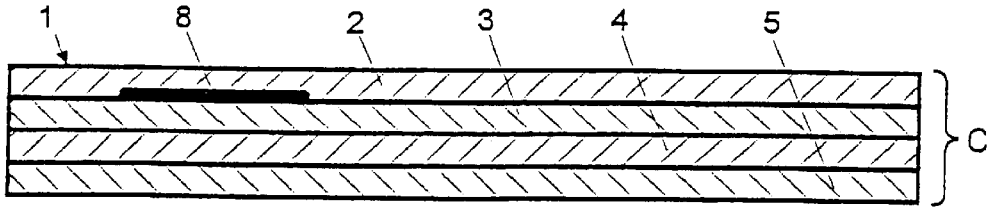
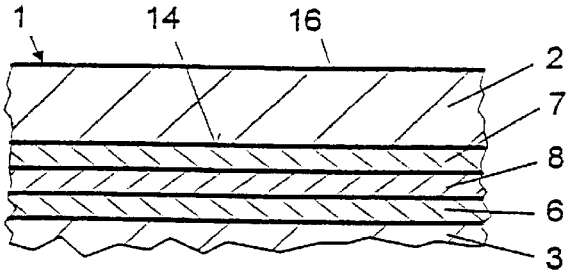
Fig. 2
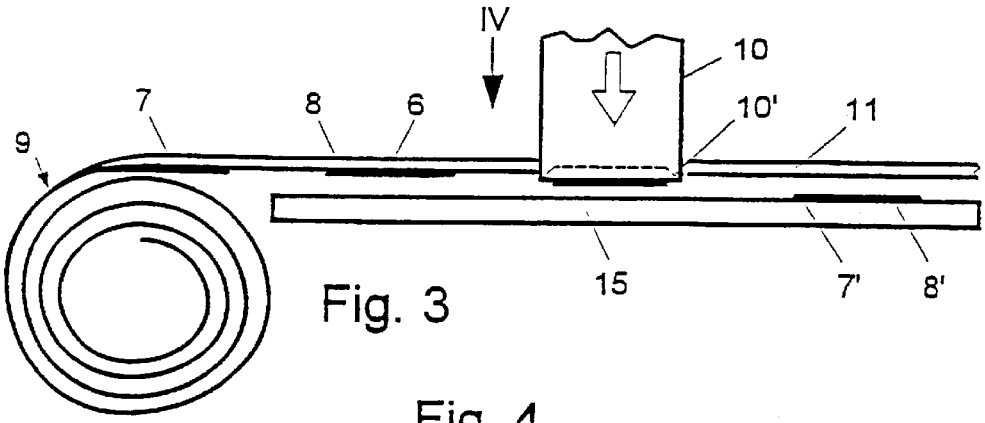
Fig. 3
Fig. 4
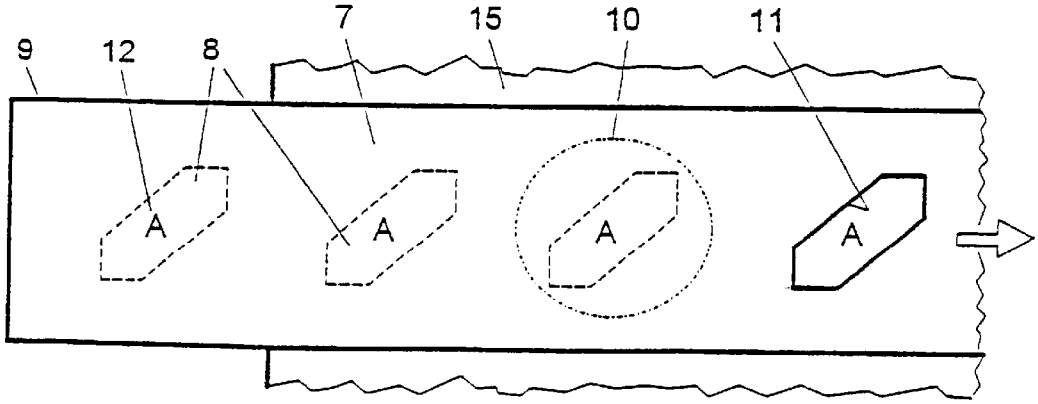

DATA CARRIER AND METHOD FOR PRODUCING SAME

BACKGROUND OF THE INVENTION

1. Field of the Invention

This invention relates to a data carrier and a method for producing same. The data carrier is in particular an identification card or payment card with at least one layer that forms a card body and a transparent outer layer laminated thereon, as well as at least one planar security element that is provided with security information, in particular holographic or kinegraphic information.

2. Description of the Related Art

Data carriers of the type described above are used as, among other things, identification cards or payment cards or as "data pages" in passports. Reference is made to the prior art as described in DE 3048733 C, DE 3151407 C, DE 4134539 A, DE 3840729 C and EP 0,230,497 A. U.S. Pat. No. 5,658,411 discloses a method for the manufacture of a laminate that can be an identification card. In that case, a protective layer is laminated onto a security element. The security element can contain holographic information and is on the uppermost layer of a card body. A technician skilled in the art will also be aware that the protection of such data carriers against counterfeiting can be significantly increased by a kinegraphic or holographic security element. Such security elements are applied to the data carrier by means of a hot press stamping process, for example. In that case, the security elements are vapor-deposited on the underside of a strip-format carrier film. These security elements are transferred by means of a heated stamp in the hot stamping process. After the hot stamping, the strip-format carrier film is pulled off. The vapor-deposited layer is an extraordinarily thin layer of metal, e.g. aluminum. It has now been shown that such security elements can be damaged as a result of wear or other stresses and can thereby completely lose their security function. To prevent this loss of the security function, the prior art discloses that the security element can be coated with a lacquer after the stamping. However, such a protective lacquer cannot be used on all data carriers, and also wears off after years of use.

SUMMARY OF THE INVENTION

The object of the invention is to create a data carrier of the type described above in which the security function of the security element is retained longer, and which can nevertheless be manufactured economically.

The invention teaches a data card of the type described above in which the security element is located between two layers that are laminated to each other and is provided with a protective layer, whereby at least one of the laminated layers is a transparent outer layer. On the data carrier claimed by the invention, the security element is laminated between two layers and thus has extraordinary protection against damage. The protective layer on the security element makes it possible to laminate the security element without damaging it. The security element is subjected to thermal and mechanical stresses during the lamination process. It has now been determined that when there is a protective layer, the lamination can be performed without the formation of cracks and especially microcracks in the extraordinarily thin security element. The security element remains clear and unclouded on account of the presence of the protective layer and is easy visible through the transparent cover layer.

In one development of the invention, the protective layer is a plastic film and in particular a carrier film on which the security element has been vapor deposited. Carrier films of this type of this type are themselves part of the prior art and can be made of polyester, for example. A sealing layer is applied on the underside of the vapor deposited security elements. By means of a hot sealing stamp which is provided with an additional punch contour, the security element is punched out of the carrier film and attached to a layer under the action of heat. In contrast to the methods of the prior art, the punched carrier film remains on the security element and is laminated between two layers on the data carrier claimed by the invention. The carrier film punched out with the security element protects the security element against damage during the lamination process.

In an additional development of the invention, the protective layer is made of a plastic that is essentially not connected with the layer to be laminated thereon. The invention teaches that a loose connection of this type does not adversely affect the stability and adherence of the data carrier in any way.

The data carrier claimed by the invention has in particular layers made of polycarbonate. The problem of damage to the security element is particularly great on polycarbonate data carriers because, in contrast to a card made of PVC, the security element cannot be recessed and is therefore particularly exposed to abrasion. Polycarbonate is suitable for use in the manufacture of, among other things, government identification cards that can remain valid and in use for many years, and for which such security elements are particularly important. On the data carrier claimed by the invention, however, the security element is fully protected against damage and against tampering.

In the method taught by the invention, at least one transparent layer is laminated onto another layer, and a planar security element that bears security information is applied. The invention teaches that the security element is laminated between two layers and is provided with a protective layer that is also laminated between the two layers. In this case, the security element is preferably protected by a protective layer applied to it. Prior to the lamination, the security element is preferably vapor deposited onto a carrier film. This carrier film remains on the security element and during the lamination process forms the above mentioned protective layer.

A particularly effective security against counterfeiting is achieved if, as taught by an additional development of the invention, the security element is a holographic or kinegraphic element. One essential advantage of the invention is that the manufacturing process is no more expensive than the methods of the prior art.

BRIEF DESCRIPTION OF THE DRAWINGS

Exemplary embodiments of the invention are explained in greater detail below and are illustrated in the accompanying drawings, in which:

FIG. 1: is a section through a data carrier as claimed by the invention,

FIG. 2: is an enlarged detail of a data carrier as claimed by the invention, FIG. 3 is a schematic illustration of the application of a security element by means of hot stamping, FIG. 4 is a schematic view of FIG. 3 in the direction of Arrow IV.

DETAILED DESCRIPTION OF THE PREFERRED EMBODIMENTS

Figure 5:
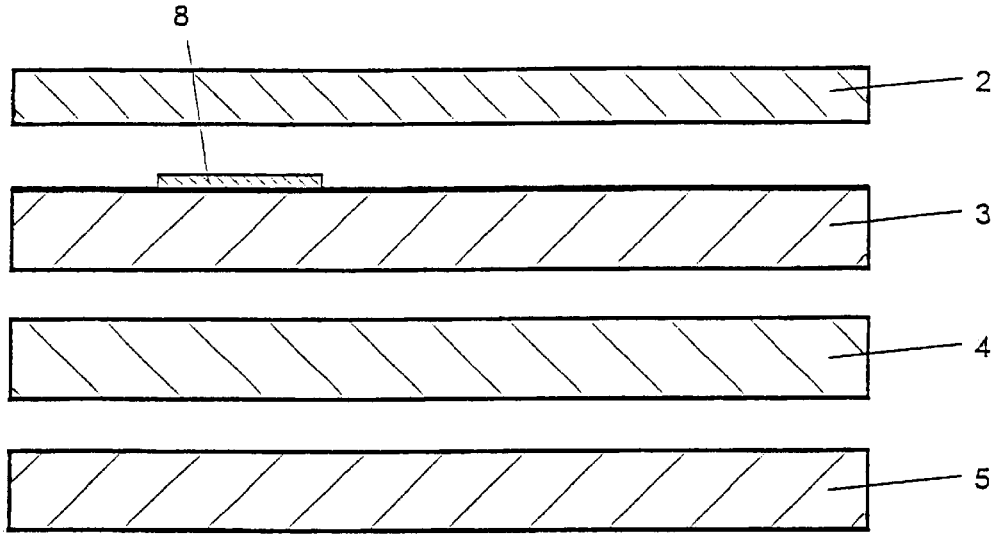
FIG. 5 is a schematic illustration of the individual layers of a data carrier as claimed by the invention.

The data carrier 1 illustrated in cross section in FIG. 1 is, for example, a government identification card of a credit card. A card body C is formed by three layers 3, 4 and 5. These layers are preferably connected to one another, for example, by a lamination process. These layers 3, 4 and 5 form the core films and are made of PVC or polycarbonate, for example. The card body C can also consist of more or fewer layers. A top cover layer 2 is transparent and is laminated onto the layer 3. A security element 8 is laminated in between the layers 2 and 3, and as illustrated in FIG. 2 is located between a hot sealed layer 3 and a protective layer 7.

The security element 8 is preferably a kinegraphic or holographic element and is formed, for example, by a metal layer that has been vapor deposited onto the layer 7. The manufacture of such security element 8 is itself described in the prior art. The metal layer can be an aluminum layer, for example, although other metals can also be used.

The security element 8, with the hot sealed layer 6, is connected firmly and in a flat connection with the layer 3 underneath it. Between the cover layer 2 and the protective layer 7 however, there is no essentially permanent connection. The contact surface 14 illustrated in FIG. 2 thus forms a loose connection between the protection layer 7 and the cover layer 2. The protective layer 7, like the cover layer 2, is transparent. The security element 8 is therefore clearly visible on the upper side 16 of the data carrier 1. The information 12 applied to the security element 8 is thus also visible (FIG. 4), i.e. holographic and kinegraphic elements, in particular characters and graphic elements. Instead of a single cover layer 2, there can also be a plurality of cover layers, although they must all be transparent.

Figure 6:
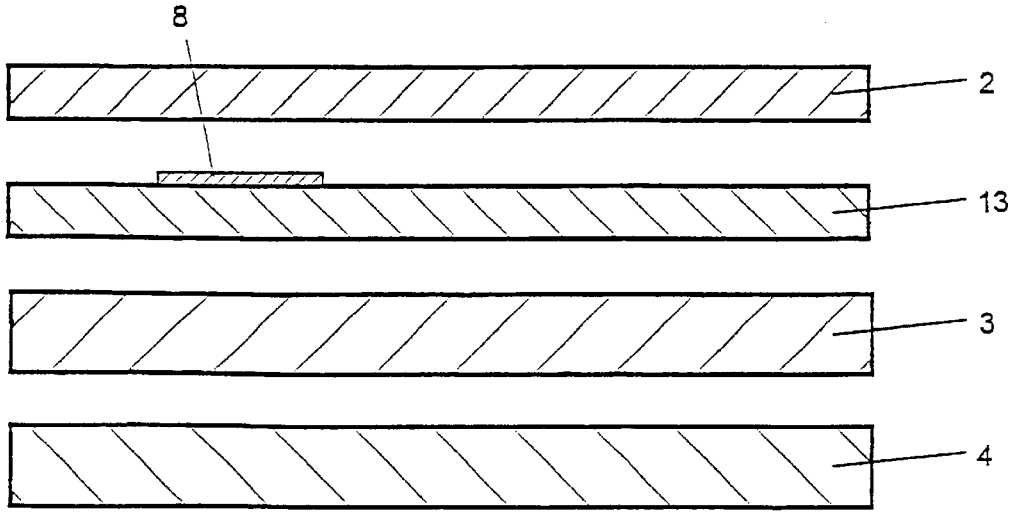
FIG. 6 is a schematic view of FIG. 5 for a variant of a data carrier as claimed by the invention.

FIG. 5 shows the data carrier illustrated in FIG. 1, whereby the individual layers are pulled apart. In the exemplary embodiment illustrated in FIG. 6, there are two cover layers 2 and 13, and the security element 8 is laminated between these two layers.

The method claimed by the invention is explained below with reference to FIGS. 3 and 4.

The security elements 8 to be laminated are vapor deposited on a protective layer 7, preferably a strip-format carrier film 7. The protective layer 7, with the vapor-deposited security elements 8, forms a strip 9 that preferably forms a roll. To laminate the security elements 8, the strip 9 is pulled by means of a sheet 15. By means of a stamp 10, the security elements 8 are punched out of the strip 9 and are applied to the sheet 15 under the action of heat. The sealing layer 6 applied to the underside of the security element 8 is thereby heated in the manner of the prior art and connects the security element 8 with the sheet 15. On the underside of the stamp 10 there is a cutting edge 10', by means of which the security element 8 and the corresponding area of the protective layer 7 are punched. After the punching, there is a hole 11 in the strip 9, as illustrated on the far right in FIG. 3. It is then essential that after the hot sealing, the punched area 7' of the carrier film remains on the punched out security element 8', as also illustrated on the far right in FIG. 3. The sheet 15 is large enough that a plurality of such security elements 8' can be applied at some distance one after the other, and a plurality of data carriers 1 can be punched out of the sheet 15. If the sheet 15 is provided with all its security elements 8', the additional sheets provided are laminated on top of and underneath this sheet. Finally, the data carrier 1 is punched out of the sheets, which are connected with one another. The sheet 15 thereby forms the layers 3 of the punched out data carrier 1.

What is claimed is:

1. An identification card or payment card, comprising:

at least one layer that forms a card body;

a transparent cover layer laminated on the at least one layer that forms the card body; and at least one planar security element that is provided with security information, wherein the security element is located between two laminated layers and is provided with a protective layer that is a carrier film, and at least one of the laminated layers is transparent.

2. The identification card or payment card as claimed in claim 1, wherein the security element is located between the transparent cover layer and a second transparent cover layer.

3. The identification card or payment card as claimed in claim 1, wherein at least one of the layers that forms the card body is manufactured from polycarbonate.

4. The identification card or payment card as claimed in claim 1, wherein the security element is firmly connected on its underside to the at least one layer that forms the card body by hot sealing.

5. The identification card or payment card as claimed in claim 1, wherein the protective layer is in essentially loose contact on its upperside with the transparent cover layer.

6. The identification card or payment card as claimed in claim 1, wherein the protective layer is a transparent plastic film.

7. The identification card or payment card as claimed in claim 6, wherein the protective layer is made of polyester.

8. The identification card or payment card as claimed in claim 7, wherein the security element is vapor deposited onto the protective layer.

9. The identification card or payment card as claimed in claim 6, wherein the security element is vapor deposited onto the protective layer.

10. The identification card or payment card as claimed in claim 1, wherein the security element is stamped onto the at least one layer that forms the card body.

11. The identification card or payment card as claimed in claim 1, wherein the security element has a thickness that is less than approximately $5\mu$.

12. The identification card or payment card as claimed in claim 1, wherein the security information is one of holographic and kinegraphic information.

13. A method for manufacturing an identification card or payment card, comprising the steps of:

applying a planar security element that carries security information between at least one transparent layer and an additional layer, wherein the planar security element is provided with a protective layer that is a carrier film; and laminating the at least one transparent layer onto the additional layer.

14. The method as claimed in claim 13, wherein the security element is vapor deposited onto the carrier film.

15. The method as claimed in claim 14, wherein the security element is made of a vapor-deposited metal.

16. The method as claimed in claim 13, wherein the security element is a holographic or kinegraphic element.

17. The method as claimed in claim 13, wherein the security element is applied to the additional layer by a stamping process.

18. The method as claimed in claim 13, wherein the security element is provided with a sealing layer on an underside of the security element.

19. The method as claimed in claim 17, wherein the stamping process is a hot stamping or a hot press stamping process.

* * * * *